United States Patent [19]

Tait

[11] 4,099,322

[45] Jul. 11, 1978

[54] METHOD FOR MAKING PLUG-IN FUSE ASSEMBLIES

[75] Inventor: Robert J. Tait, Arlington Heights, Ill.

[73] Assignee: Littelfuse, Inc., Des Plaines, Ill.

[21] Appl. No.: 766,239

[22] Filed: Feb. 7, 1977

[51] Int. Cl.[2] ..... H01H 69/02

[52] U.S. Cl. ..... 29/623; 29/33 K; 29/417

[58] Field of Search ..... 29/DIG. 15, DIG. 26, 29/33 K, 414, 417, 610 R, 623; 339/62, 147 P, 208; 337/187, 201, 206, 255, 262, 263, 264, 293, 295, 297, 198; 113/116 P, 116.4, 119

[56] References Cited

U.S. PATENT DOCUMENTS

| | | | |
|---|---|---|---|
| 3,909,767 | 9/1975 | Williamson et al. | 337/198 X |
| 3,962,782 | 6/1976 | Williamson et al. | 29/623 |
| 4,023,264 | 5/1977 | Schmidt et al. | 29/623 |
| 4,023,265 | 5/1977 | Aryamane | 29/623 |
| 4,040,175 | 8/1977 | Williamson et al. | 29/623 |
| 4,056,884 | 11/1977 | Williamson et al. | 29/623 |

*Primary Examiner*—Victor A. DiPalma
*Attorney, Agent, or Firm*—Wallenstein, Spangenberg, Hattis & Strampel

[57] ABSTRACT

A method and apparatus for making plug-in fuse assemblies utilizing a strip of fuse metal having longitudinally spaced blank portions from which individual plug-in fuse elements are to be formed, each blank portion having corresponding portions spaced transversely of the length of the strip from which said fuse link portions, on the one hand, and at least said terminal blade portions, on the other hand, of a plug-in fuse element is to be formed. The strip of fuse metal is advanced past punch and die assemblies which form in each blank portion of the strip a pair of parallel confronting terminal blade portions and current-carrying extensions interconnected by a fuse link portion. A punch unit and a backing means therefor having a width no greater than about the length of each pair of terminal blade portions are positioned on opposite sides of the terminal blade portions of the end blank portion of the strip and the punch is moved against the terminal blade portions of the end blank portion of the strip to sever the same from the strip and to bring the severed blank against the backing means where it is clamped securely between the punch and the backing means. An insulating unit, preferably constituting a housing, with an entry opening at one end adapted to receive the current-carrying extensions and fuse link portion of the severed end blank is held by a housing applying unit which moves the housing over the current-carrying extensions of the end blank clamped between the punch and said backing means.

2 Claims, 21 Drawing Figures

FIG. 5
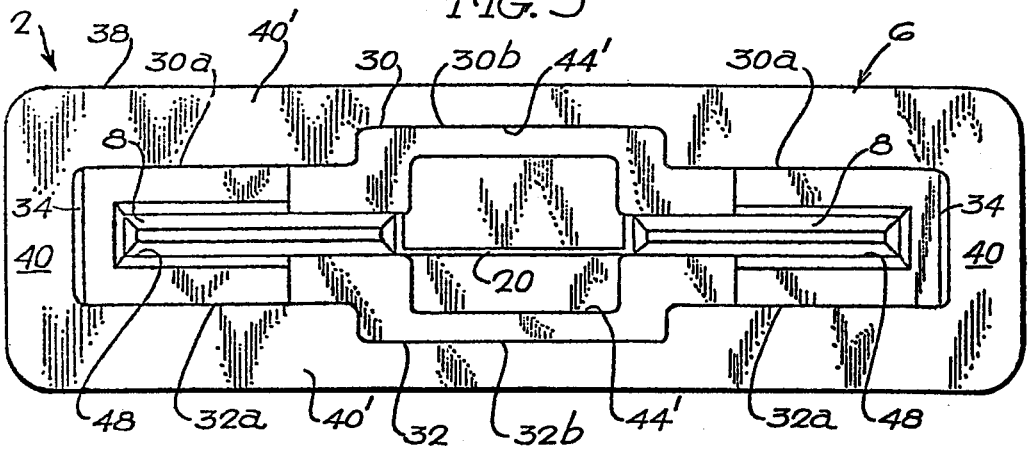
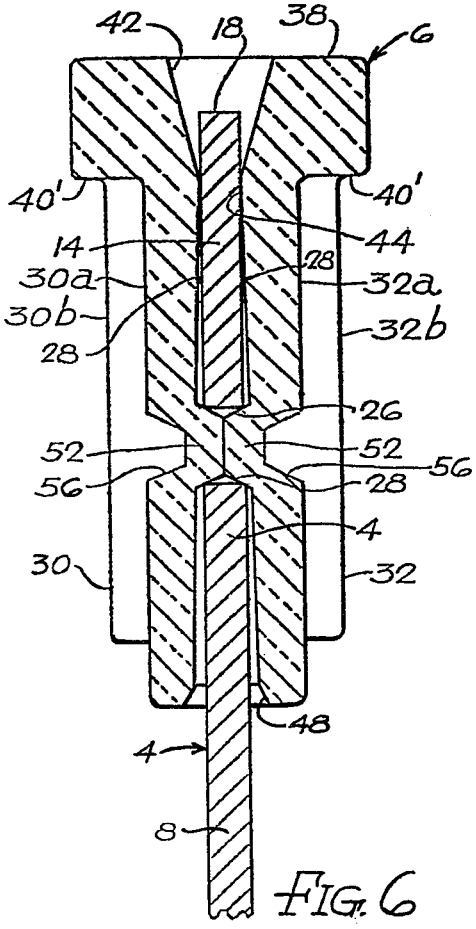
FIG. 6
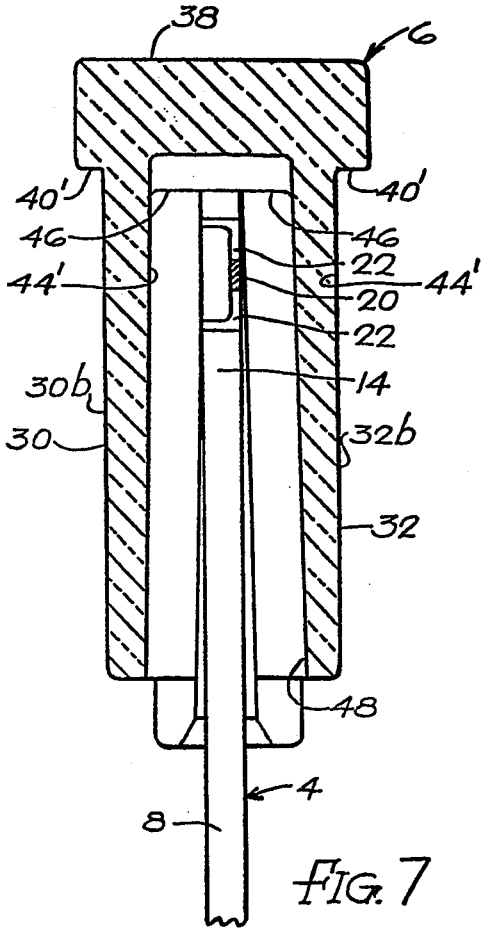
FIG. 7

METHOD FOR MAKING PLUG-IN FUSE ASSEMBLIES

RELATED APPLICATIONS

This application relates to apparatus for making fuses disclosed in U.S. Pat. Nos. 3,909,767 granted Sept. 30, 1975 and 3,962,782 granted June 15, 1976.

BACKGROUND OF THE INVENTION

Briefly, this invention has to do with apparatus for making a plug-in fuse assembly like that disclosed in said U.S. Pat. Nos. 3,909,767 and 3,962,782 which preferably comprises a plug-in fuse element including a plate-like body of fuse metal having a pair of laterally spaced terminal blade portions to be received by pressure clip terminals in a mounting panel, current-carrying extensions at the inner end portions of the pair of terminal blade-portions and a fuse link portion generally of reduced thickness and very small cross-sectional area interconnecting the current-carrying extensions.

Generally, the method of making such a plug-in fuse assembly disclosed in said U.S. patents comprises providing a blank of fuse metal which is blanked or stamped to provide the pair of laterally spaced terminal blade portions which, when the fuse link portion to be formed therefrom are very fragile, and interconnected by a transverse relatively rigid web. The exposed transverse web interconnecting the pair of terminal blade portions adds rigidity to the blank and securely maintains the relative positions of the pair of terminal blade portions, the current-carrying extensions and the fragile interconnecting link portion of reduced thickness, as a housing or the like is inserted over and secured to the blank. Thus, distortion, breakage or other damage to the blank is effectively prevented during these operations.

The housing is preferably inserted over the blank of fuse metal, preferably by way of an opening at the inwardly facing side of a one piece body insulating material forming the housing, with the current-carrying extensions and the interconnecting fuse link portion of the blank preferably within the housing and with the pair of terminal blade portions of the blank, which are generally interconnected by the relatively rigid transverse web where the fuse link portion is fragile, extending outwardly from the housing preferably through the opening therein. The blank of fuse metal is suitably secured in the housing as by staking or the like. The housing is thus secured to the blank so that it acts as a rigid insulating body connected between the current-carrying extensions and/or terminal blade portions of the partially enclosed plug-in fuse element. While less desirable, the housing function for this body of insulating material can be eliminated so it acts only as a rigid support and, if desired, a convenient gripping surface for the plug-in fuse element. Where used, the exposed transverse web of fuse metal interconnecting the exposed terminal blade portions of the blank is then blanked or otherwise removed to complete the formation of a housed plug-in fuse element whose exposed pair of terminal blade portions may be inserted into metal sockets or the like of a terminal strip.

For maximum mass production efficiency of the housed plug-in fuse element just described, the blank of fuse metal from which each plug-in fuse element is formed is preferably part of a long strip of fuse metal upon which various blanking operations are performed as the strip moves past various stamping stations. The individual plug-in fuse elements are not completely separated from the strip until just before or after the housing is applied thereto at the end of the strip. The fuse link portions of the plug-in fuse elements are, as previously indicated, preferably of reduced thickness from that of the rest of the fuse-forming elements, and, in the case where the fuse elements are formed from a strip as just described, it is most convenient to provide the strip with a continuous band of reduced thickness extending parallel to the length of the strip, and preferably in the central portion thereof. As disclosed in copending application Ser. No. 698,072, filed June 21, 1976, on a Method of Making Miniature Plug-In Fuses of Different Fuse Ratings, plug-in fuse elements of different ratings are formed by varying the locations and/or configurations of the fuse-forming links stamped from the reduced portion of the strip.

One of the cost saving and size reducing aspects of the method of making plug-in fuses just described is that each plug-in fuse element is a stamping made from a blank or strip of fuse metal, and a completely housed fuse results from merely enclosing the same in an insulating housing, so that the entire fuse assembly is formed of only two parts, and without any soldering operations required to connect a fuse link between the terminal portion of the fuse. The manufacturing costs are reduced to a minimum when various blanks form interconnected portions of a strip of fuse metal so that the strip acts as a carrier for the blanks as they are successively moved passed stamping dies which carry out the blanking operations just described. The aforementioned band of reduced thickness in the strip most advantageously passes through the center of the strip so that by blanking the reduced thickness portion of the strip there is left on opposite sides thereof said terminal blade portions and current-carrying extensions thereof extending parallel to the strip. (However, in accordance with the broadest aspects of the method invention disclosed in said patents, in the form of the invention where blanks are interconnected in a strip, the blanking operation may be carried out so that the terminal blade portions extend transversely rather than longitudinally of the strip, in which event the band of reduced thickness could extend along one margin of the strip or off-centered thereon.) The assembly of a housing on the strip is probably made easier by this method where the band of reduced thickness extends centrally of the strip and is blanked so that the terminal blade portions and their extensions are oriented longitudinally of the strip because a housing having an entry opening at one end can be readily slipped over an exposed longitudinally facing end of an end blank of the strip, either before or after it is severed therefrom, to encompass the portion of the blank other than the terminal blade portion thereof which are to project from the housing.

The present invention relates to a method and apparatus for simply and reliably inserting the housing over the blank of the strip either before or after it is severed from the strip, but preferably after it is severed therefrom.

SUMMARY OF THE INVENTION

While the fragile fuse link is supported to a considerable extent by the aforementioned web extending between the terminal blade portions thereof, the end blank forming an almost completed plug-in fuse element needs to be held securely in a fixed position while the housing is pushed thereover. In accordance with a broad aspect of the invention, immediately prior to the application of the housing over the plug-in fuse element formed in the end blank of the strip, only the terminal blade portions of the plug-in fuse element involved are clamped in place to leave the current-carrying extensions and the fuse link extending therebetween exposed to receive the housing.

In accordance with a specific aspect of the invention, the clamping means which clamps the terminal blade portions of the end blank of the strip also constitutes a punch for punching the end blank from the strip. In such case, the end blank is passed between a punch and a backing means where the punch initially makes contact with the terminal blade portions of the end blank and then after severing the same from the strip clamps the same against a backing member.

In accordance with another feature of the present invention, the punch operates in conjunction with a cutting edge formed at the juncture between a backing wall surface extending at right angles to the length of the strip and a wall extending longitudinally of the strip, so that after the blank has been severed from the strip and clamped in place between the punch and the backing member, the housing may be pushed over the current-carrying extension end of the blank toward the backing wall surface against which the terminal blade portions bear during the housing application operation.

Other aspects of the invention deal with the unique design of the means which holds the housing unit and moves the same into relationship with a severed end blank. These and other aspects of the present invention will become apparent upon making references to the specification to follow the drawings and the claims.

DESCRIPTION OF THE DRAWINGS

FIG. 5 is an enlarged bottom view of the plug-in fuse assembly of FIG. 1;

FIG. 6 is an enlarged transverse vertical sectional view through the plug-in fuse assembly shown in FIG. 4, taken along section line 6—6 thereof;

FIG. 7 is an enlarged vertical transverse sectional view through the center portion of the plug-in fuse assembly shown in FIG. 4, taken along section line 7—7 thereof;

DESCRIPTION OF THE PREFERRED EMBODIMENT OF THE INVENTION

Referring now more particularly to FIGS. 1–4, there is shown in plug-in fuse assembly 2 to be made by the method of the invention illustrated in FIGS. 9–11 and 14–15 to be described. This assembly is made of only two component parts, namely a plug-in fuse element 4 which is a single stamping from a strip of fuse metal, and a housing 6 which most advantageously is a single piece synthetic plastic molded part defining a space therein into which portions of the plug-in fuse element 4 extend and are secured in any suitable way, but most preferably by a cold staking and ultrasonic welding operation to be described.

Figure 1:
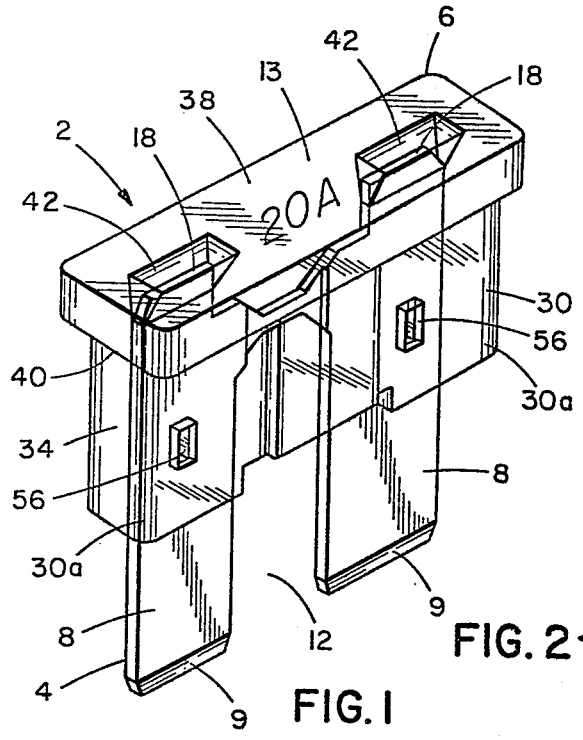
FIG. 1 is a perspective view of a preferred form of the plug-in fuse assembly made by the method of the invention.
Figure 2:
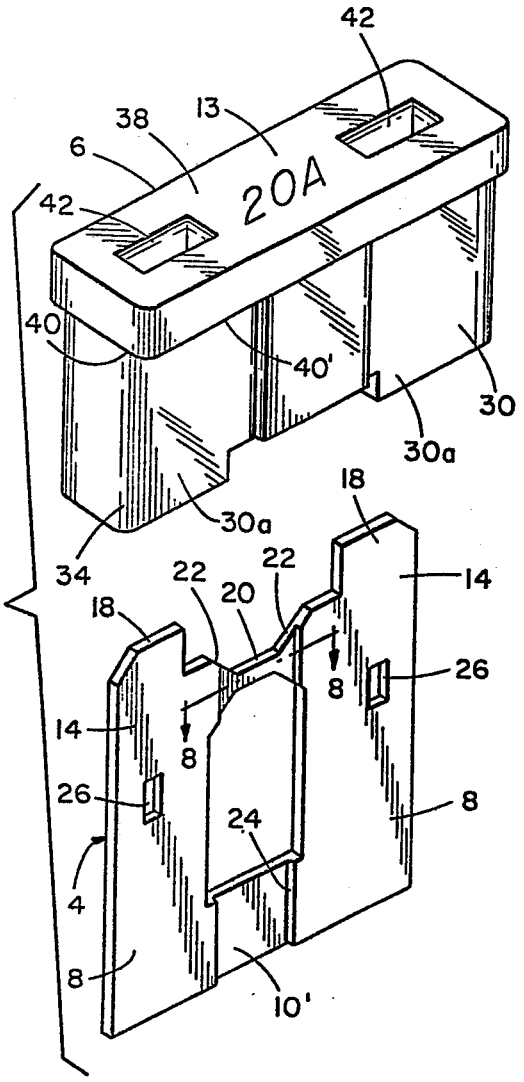
FIG. 2 is an exploded view of the housing and plug-in fuse element for making up the plug-in fuse assembly of FIG. 1.
Figure 3:
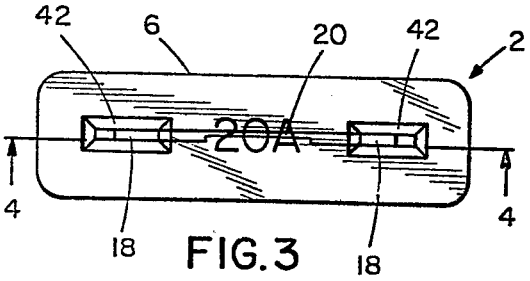
FIG. 3 is a top plan view of the plug-in fuse assembly of FIG. 1.
Figure 4:
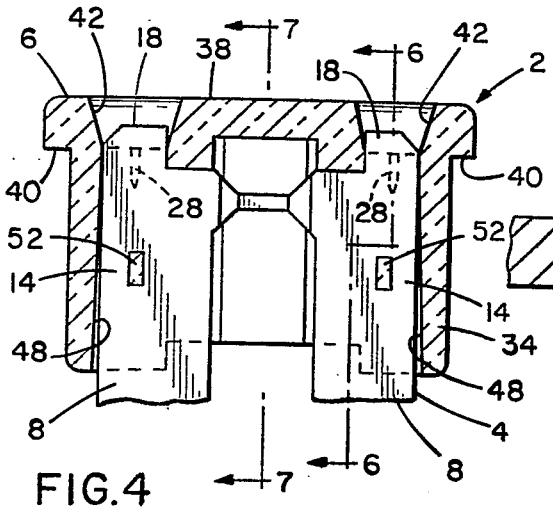
FIG. 4 is a vertical longitudinal sectional view through the plug-in fuse assembly shown in FIG. 3, taken along section line 4—4 therein.
Figure 8:
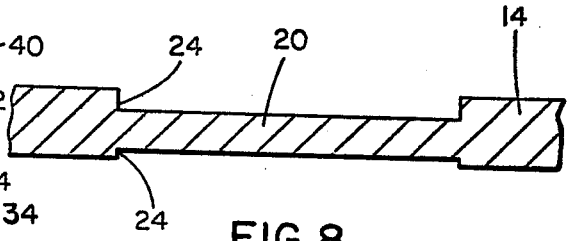
FIG. 8 is an enlarged fragmentary sectional view through the fuse link portion of the plug-in fuse element shown in FIG. 2, taken substantially along section line 8—8 therein, and showing the preferred manner in which the fuse link portion thereof is reduced in thickness.

The plug-in fuse element 4 has terminal blade portions 8—8 plated with a highly conductive metal like tin extending in spaced parallel relationship from the inner or bottom margin of the housing 6 in what will be referred to as a downward or inwardly extending direction. The ends of the terminal blade portions 8—8 of the plug-in fuse element, which are spaced apart as indicated at 12, are most advantageously tapered at 9—9 to form pointed end portions which readily slip into place between the confronting walls of conventional spring clip terminals (not shown) supported in mounting panel sockets. The current rating of the plug-in fuse assembly is indicated by indicia 13 on the outer wall of the housing as shown in FIGS. 1–2 and/or by a distinctive housing color.

Figure 12:
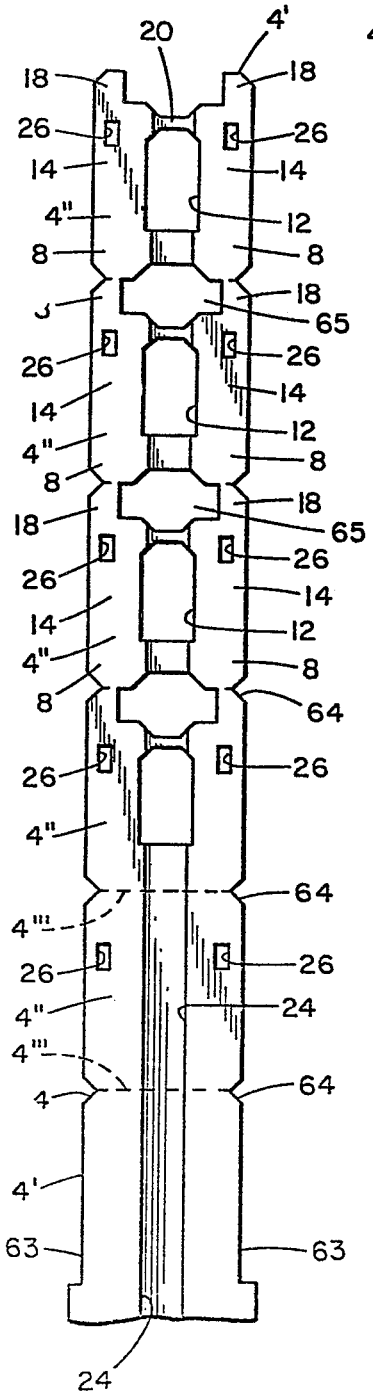
FIG. 12 illustrates the method of blanking the strip of fuse metal shown in FIG. 11, to provide plug-in fuse elements of the design shown in FIGS. 2 and 4.
Figure 9:
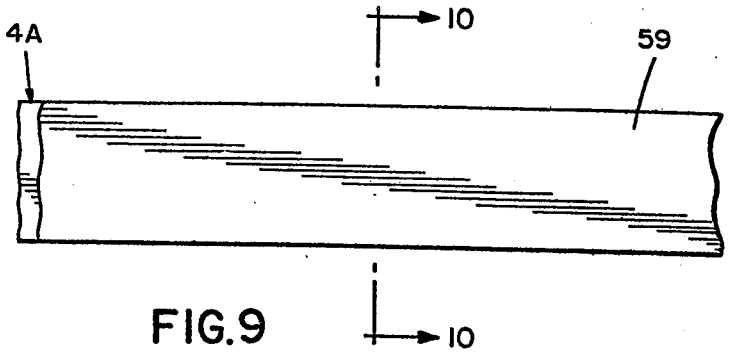
FIG. 9 is a top view of a strip of fuse metal from which fuse elements like that shown in FIGS. 1–8 are made and which has been plated over all of the surfaces with a suitable conductive coating prior to its being grooved and stamped to form a plurality of plug-in fuse elements.
Figure 10:
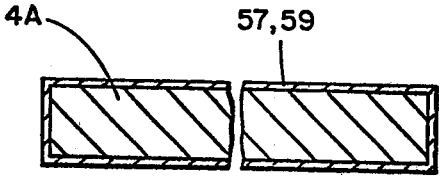
FIG. 10 is a sectional view through the plated strip of fuse metal shown in FIG. 9, taken along section line 10—10 therein.
Figure 11:
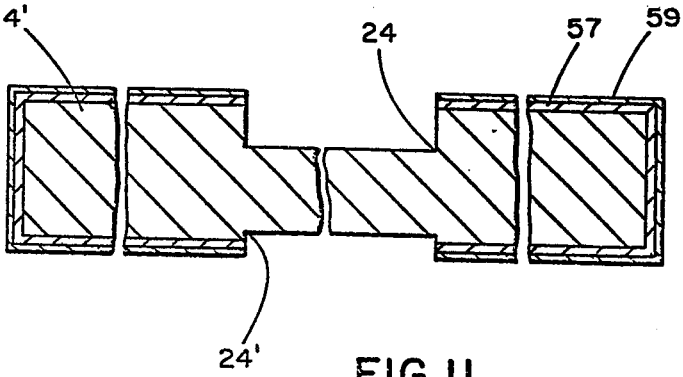
FIG. 11 illustrates the plated strip of fuse metal in FIG. 9 and 10 after it has been milled to form grooves in the opposite faces thereof in the fuse link-forming portions of the strip, to remove the plating material thereon and form areas of reduced thickness in the strip from which the fuse link portions of the fuse elements are formed.

The plug-in fuse element 4 may be formed from a partially tin plated strip 4' of fuse metal (FIGS. 11 and 12). Prior to the plug-in fuse element being severed from the strip 4', the terminal blade portions 8—8 may be interconnected by a transverse rigidifying web 10' stamped from a reduced central portion of the transverse web. The stamping operating also forms the terminal blade portions 8—8 separated by a gap 12. The tapered portions 9—9 of the terminal blade portions 8—8 may be formed by coining dies preferably after the operation which severs the plug-in fuse element from the strip. (The efficient mass production of the entire plug-in fuse assembly 2 is best achieved by apparatus like that illustrated in FIGS. 13–21 to be described.)

The terminal blade portions 8—8 have current-carrying extensions 14—14 which are preferably tin plated at least at the outer end portions thereof where checking probe-receiving tabs 18—18 are formed. The current-carrying extensions project into the aforementioned space formed by the housing 6 where they are contiguous to the front or outer wall of the housing to be described. The current-carrying extensions 14—14 are interconnected by an unplated fuse link portion 20 which is preferably both narrower in width and much smaller in thickness than the other current-carrying portions of the plug-in fuse element 4. However, especially large current rated fuses could have the same thickness as the other portion of the plug-in fuse element. The current-carrying capacity of the fuse link portion 20 may be varied by varying its location and its configuration including its width and length dimensions. In the particular configurations of the plug-in fuse element 4 shown in FIGS. 2 and 4 the current-carrying extensions 14—14 join the fuse-forming link portion 20 of the plug-in fuse element 4 by tapered portions 22—22. All of the various parts of the plug-in fuse element are shown substantially in coplanar relation.

The reduction of the thickness of the fuse metal of the fuse-forming link portion 20 is preferably achieved by initially providing in the strip 4' of fuse metal just before it is plated and, hence, the blanks 4'' of the strip, with a relatively deep groove 24 on one face thereof preferably extending longitudinally centrally throughout the strip 4', as shown in FIG. 11, to provide a longitudinally extending central portion of substantially reduced thickness in the strip 4' and the blanks 4'' thereof.

A shallow groove 24' is formed in the opposite face of the fuse metal strip for reasons to be explained. Different desired fuse ratings of the plug-in fuse assembly are determined by the composition of the fuse metal in the strip 4 of fuse metal, the thickness dimension of the fuse link portion 20, the location of the fuse link portion 20, and the configuration of the fuse forming link portion 20 including width and length dimensions. The composition of the fuse metal and the thickness dimensions of the fuse link portion 20 can be fixed parameters for making fuse elements having a number of different fuse ratings. The different desired fuse ratings are then obtained by selectively arranging the fuse link portions 20 of fixed reduced thickness dimension in desired locations and by selectively providing the fuse link portions 20 with desired configurations including width and length dimensions.

While the fuse metal strip may have a variety of compositions, one exemplary series of compositions in weight percentage is the following: 0.50–0.70% Cu; 0.12–0.18% Ti; a maximum of 0.07% Pb, 0.01% Cd, 0.01% Fe, 0.02% Cr; and the balance Zn. The strip of fuse metal as shown may have any desired maximum thickness as, for example, 0.025 inches thick. The shallow groove 24' is preferably no greater than about 0.003 inch and preferably only about 0.001 inch so that no special die wall projections need to be made to match and support this side of the strip to ensure precise stamping of the fuse link with a cutting die brought against the strip from the side thereof having the relatively deep groove 24. The deep groove 24, will generally be many times, such as 4 or more times deeper than the shallow groove, as for example, 0.013 inch. A wide range of fuse ratings may, as a practical matter, require two or three different reduced thicknesses in the fuse metal strip, but one or more of these strips are desirably used to form fuses of many different ratings. There may be also further fixed dimensions which are also present in the plug-in fuse elements regardless of the fuse ratings thereof including the length and the width dimensions of the plug-in fuse element, the dimensions of the extensions 14 and, the dimensions of the apertures 26.

While the plug-in fuse element 4 of such a high rating that the fuse link portion thereof is not fragile may be used as a fuse element without its incorporation in a housing or attachment to another body of insulating material acting only as a support structure for the terminal blade portions of the fuse element, for safety and other reasons it is preferred to incorporate the plug-in fuse element 4 in the housing 6. To this end, and to anchor the plug-in fuse element 4 within the housing 6, anchoring apertures 26—26 are formed in the terminal extensions 14—14 to receive anchoring projections to be described formed in the housing walls.

While the housing 6 could be made in two separate parts snappable or otherwise secured together, the housing is most advantageously a single piece molded part as previously indicated. Also, it preferably has a narrow elongated configuration formed by relatively closely spaced walls generally indicated by reference numeral 30–32, the side walls having end portions **30*a*–32*a* which are spaced together much more closely than the central or intermediate portions 30*b*–32*b* thereof. The side walls 30–32 are interconnected at their end margins by narrow end walls 34—34, and at their outer or top margins by an outer wall 38 which overhangs the rest of the housing to form downwardly facing shoulders 40—40 at the longitudinal ends of the outer wall 38 and downwardly facing shoulders 40'–40' along the longitudinal side margins of the housing 6**.

Terminal access opening 42—42 are provided in the outer well 38 adjacent the opposite end portions thereof in alignment with the location of the test probe-receiving tabs 18—18 of the plug-in fuse element 4. The walls of the terminal access openings 42—42 taper down to an inner dimension which approximates the width of the test probe-receiving tabs 18—18 so that test probes can be guided into contact with the tabs 18—18. The terminal access openings 42—42 communicate with the aforementioned plug-in fuse element receiving space in the housing 4. The portions 44—44 of this space immediately beneath the access opening 42—42 are relatively small because of the close spacing of the side wall portions 30*a*–32*a* of the housing at these points, the width of the space portion 44—44 as viewed in FIG. 6 tapering from the bottom open end of the housing upwardly toward the terminal access openings 42—42, reaching a narrow dimension about equal to the thickness of the plug-in fuse element 4. The space portions 44—44 are provided on opposite sides thereof with small inwardly directed ribs 28 for engaging and centering the upper portions of the plug-in fuse element 4 in the housing 6. At the inner margins of the terminal access openings 42—42 the upper wall 38 is provided with downwardly extending skirts 46—46 which act as shield walls preventing spewing fuse metal from gaining entrance to the terminal access openings 42—42. These shield forming skirts 46—46 also act as stop or abutment shoulders for the current-carrying extensions 14—14 of the terminal-forming blade portions 8—8 of the plug-in fuse element.

The fuse link portion 20 of the fuse element 4 is positioned in a relatively wide portion 44′ (FIG. 7) of the housing interior, to provide for free circulation of air around the center portion of the fuse-forming link portion, which is the part thereof which first melts under excessive current flow, so heat does not accumulate which would adversely affect the current at which the fuse will blow.

The narrow and wide portions 44—44 and 44′ of the space within the housing 6 open onto the bottom of the housing for the full extent thereof through an entry opening 48. The opening 48 permits the housing to be pushed over the end portion of end blank of the pre-stamped and milled strip 4′ from which a completed fuse element is punched and immediately following the housing 6 is secured to the end portion or end blank of the strip as previously indicated.

The housing 6 is preferably a molded part made of a transparent synthetic plastic material so that the fuse-forming filament portion 20 of the plug-in fuse element 4 is readily visible through the intermediate portion of the outer wall 38, to which the fuse-forming link portion 20 is in spaced but relatively contiguous relation. The housing is preferably molded of a high temperature material sold by Union Carbide under the trademark "POLYSULFONE" and order No. P1700, Natural 11.

While the housing interior could be made with resilient projections which snap into the anchoring apertures or openings 26—26 in the plug-in fuse element 4, it is preferred to secure the housing in place by forming projections 52 from both sides of the housing 6 by a cold staking operation, which enter the anchoring apertures 26—26 of the plug-in fuse element 4. The inwardly extending projections 52 are formed by the cold staking operation where they engage each other in the anchoring apertures or openings 26 are preferably welded together by ultrasonic welding or the like to provide a rigid anchoring structure. The depressions 56 left by the staking operation are shown in the side wall 30 in FIGS. 1 and 6.

The exemplary embodiments of the fuse assemblies described have thus provided exceedingly reliable, compact and inexpensive plug-in fuse assemblies which can be readily inserted into and removed from suitable closely spaced spring clip terminal connectors in a mounting panel by grasping the shoulders 40—40 at the longitudinal ends of the housing 6. The transparent material out of which the housing 6 is made forms a convenient window in the outer wall through which the fuse-forming link portion of the plug-in fuse element can be viewed when the plug-in fuse assembly is mounted on the mounting panel. The terminal access openings enable test equipment to test the continuity of the fuse if the user does not desire to rely solely on a visual observation of the fuse-forming link portion of the fuse.

The preferred method of making the plug-in fuse assemblies is illustrated in FIGS. 9–12. Before the strip 4′ is grooved, it preferably is a fuse metal body 4A (FIGS. 9 and 10) of the same thickness throughout. In accordance with the preferred method of fabricating the strip shown in FIGS. 9–11, the fuse metal strip is initially plated throughout with a conductive coating which does not oxidize in the surrounding air. Wherein tin is selected as this conductive coating, to prevent bleeding of the fuse metal through the tin coating an initial coating of copper 57 is most advantageously plated on all exposed surfaces of the ungrooved strip following which tin 59 is similarly plated thereon. For example, the copper plating 57 is preferably between 0.00005 and 0.0001 inches and the tin plating is preferably between 0.00015 and 0.0002 inches thick. These coatings may be applied by electroplating these metals on the surface of the ungrooved strip. The plated strip 4A is formed into the grooved strip 4′ by skiving or otherwise forming the aforementioned shallow groove 24′ to a precise depth throughout the length of one face of the strip 4A and milling or otherwise forming the relatively deep groove 24 of somewhat less depth than the ultimately desired depth throughout the length of the other face of the strip involved. The milled groove 24 is then skived or otherwise machined to a precise depth to form a fuse link-forming strip portion of precise reduced thickness.

The advancing strip 4′ of fuse metal may be first edge stamped as indicated at 63, to provide accurate width dimensions to the strip 4′ and the blanks 4″ formed therein. The strip may also be provided with notches 64 in the edges thereof at the end margins 4″ of the blanks 4″ subsequently to form edge tapers on the blade portions 8. Next, the interlock openings 26 may be blanked in the strip. Following this, the advancing strip 4′ of fuse metal may then be blanked at to form the cut-outs 12 and 65 forming the terminal blade portions 8, the current-carrying extensions 14 thereof and the further extensions or tabs 18 thereof, and the fuse link portions 20 of fixed reduced thickness dimension. This blanking may be accomplished in one blanking operation as illustrated in FIG. 12 or in a plurality of, for example two, blanking operations. In these blanking operations the transverse web 10′ still remains between the terminal blade portions 8 of each blank. Because of the groove 24 shown extending throughout the length of the strip 4′ of fuse metal, the transverse web 10′ is formed by the reduced thickness portion of the strip, but due to its substantial width it has sufficient rigidity and strength to rigidly support and space the terminal blade portions 8—8 and current carrying extensions 14—14 in the strip 4′. As thereshown, the strip 4′, which is advanced in a step-by-step fashion by suitable advancing means 69 (see FIG. 14), preferably passes with an orientation in a vertical plane and with the deeply grooved side thereof facing forwardly into a space 71 between a rear die unit 70 having various punch-receiving apertures 70*a*, 70*b*, 70*c*, 70*d*, etc. and a front strip holding member 73 having corresponding punch-receiving guideways 73*a*, 73*b*, 73*c*, 73*d* etc. in which are slidably disposed punches 72*a*, 72*b*, 72*c*, 72*d*, etc. carried by a punch carrier 72. The punch carrier 72 has a cam follower extension 72*a* against which bears a cam 75. The punch carrier 72 is separated from the strip holding member 73 by coil springs 76 compressed by the rotation of the cam 75 after the strip holding member 73 makes engagement with the strip 4'. The forwardly facing wall 70e of the die unit 70 forms a flat vertical surface except for the aforementioned punch-receiving apertures 70a, 70b, 70c, 70d, etc. as the punch carrier 72 begins to move rearwardly with regard to the strip holding member 73, the aforementioned punches 73a, 73b, 73c, 73d, etc. are forced through the strip 4' into the die member apertures 70a, 70b, 70c, 70d, etc. to form the various above described apertures in the strip 4', as shown in FIGS. 12 and 13.

Figure 13:
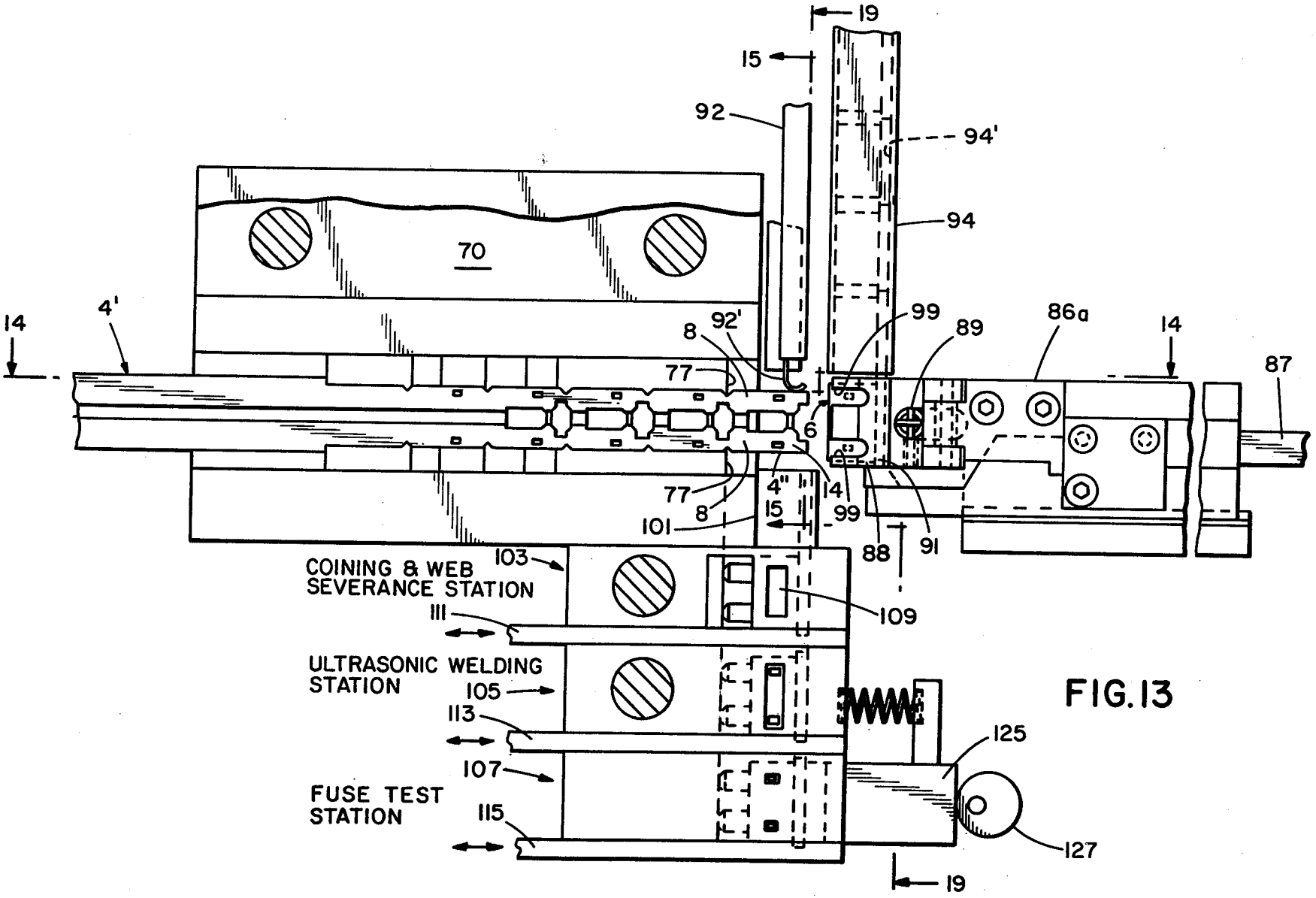
FIG. 13 is a vertical sectional view through a machine for making the plug-in fuse assembly shown in FIGS. 1 through 11.
Figure 14:
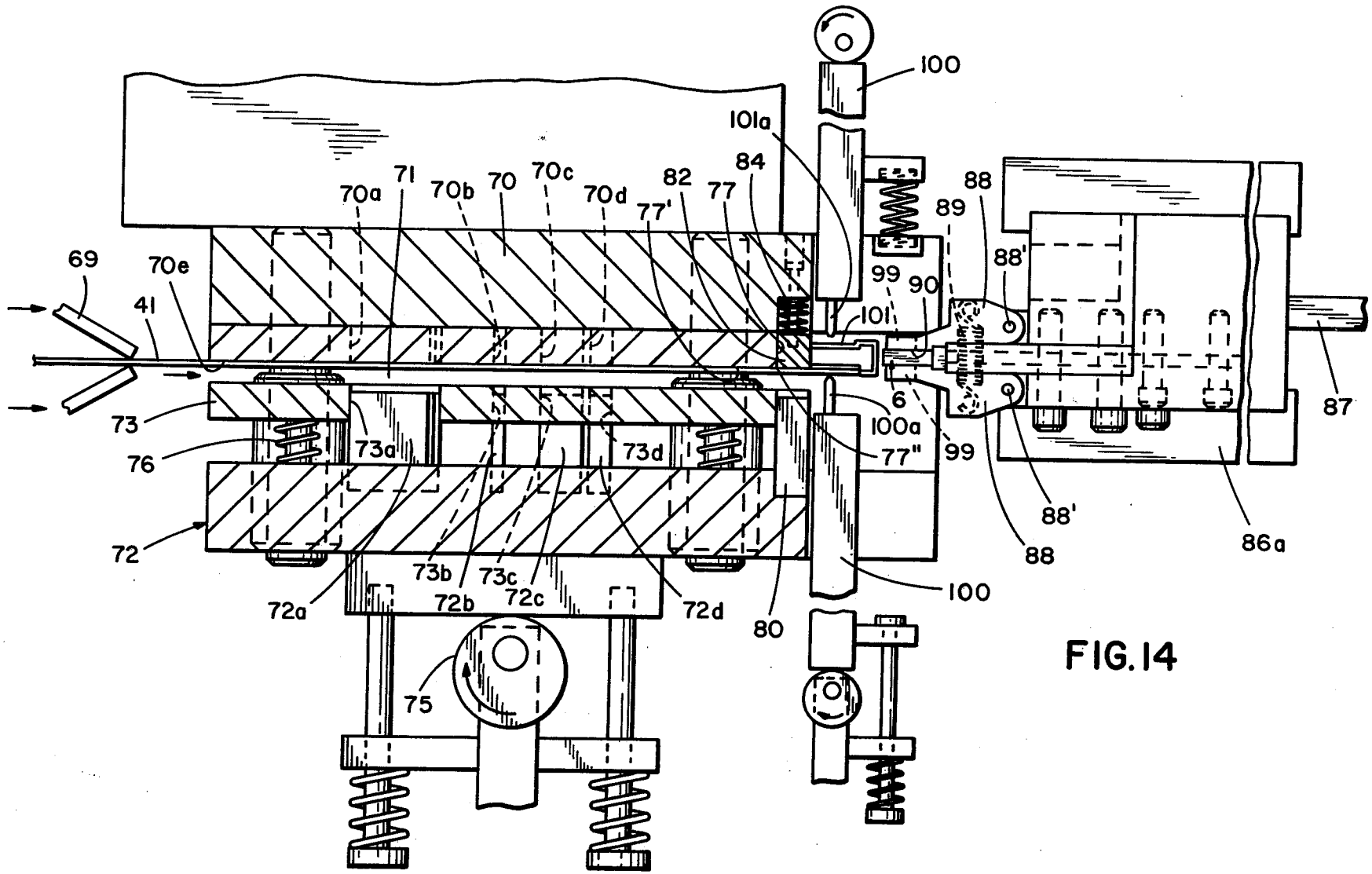
FIG. 14 is a sectional view through the machine of FIG. 13, taken along section line 14—14 therein.
Figure 15:
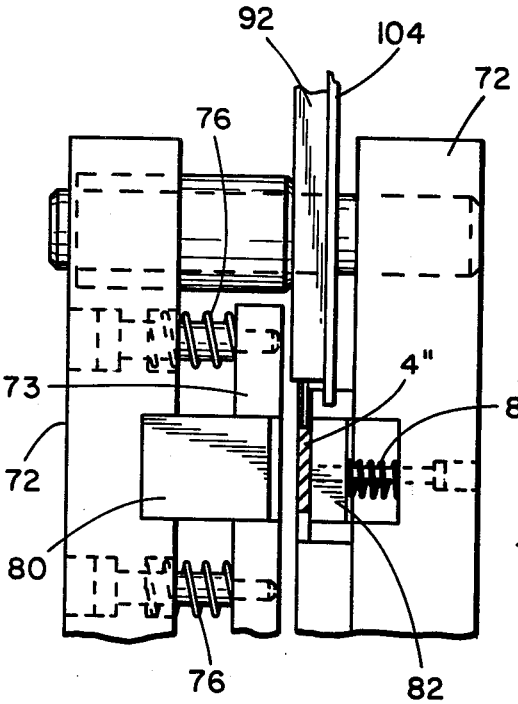
FIG. 15 is a fragmentary horizontal sectional view through the machine of FIG. 12, taken along section line 15—15 therein.
Figure 16:
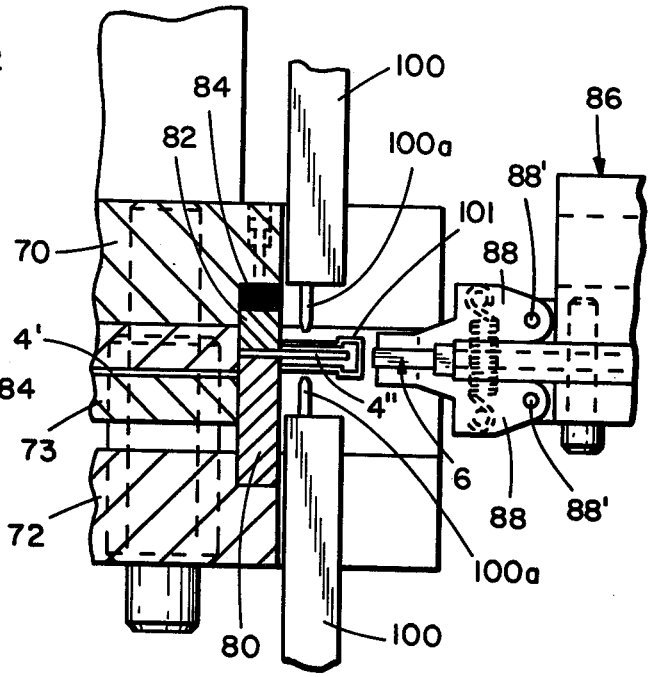
FIG. 16 is a horizontal fragmentary sectional view through a portion of the machine shown in FIG. 14 when a punch portion thereof has been moved against the end blank of the fuse metal strip to sever the same from the strip and to clamp the severed blank against a backing member.
Figure 17:
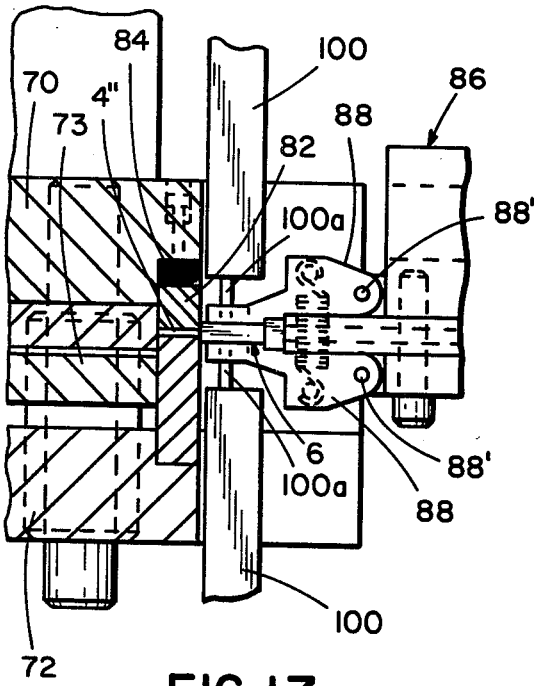
FIG. 17 is a view corresponding to FIG. 16 when the housing unit applying means shown therein has been moved into a position to apply the housing over the severed blank and the staking tool projections have been moved into a position to stake the housing upon the severed blank.
Figure 18:
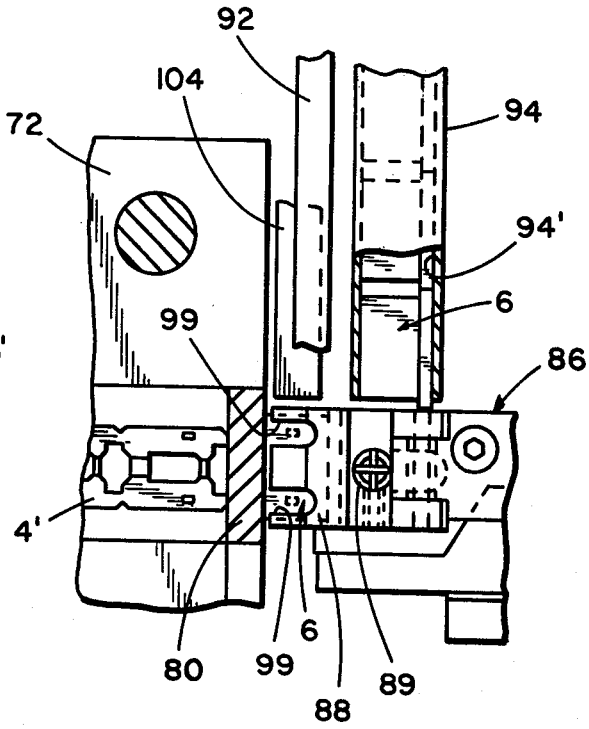
FIG. 18 is a sectional view through FIG. 17, as seen along section plate 18—18 therein.
Figure 19:
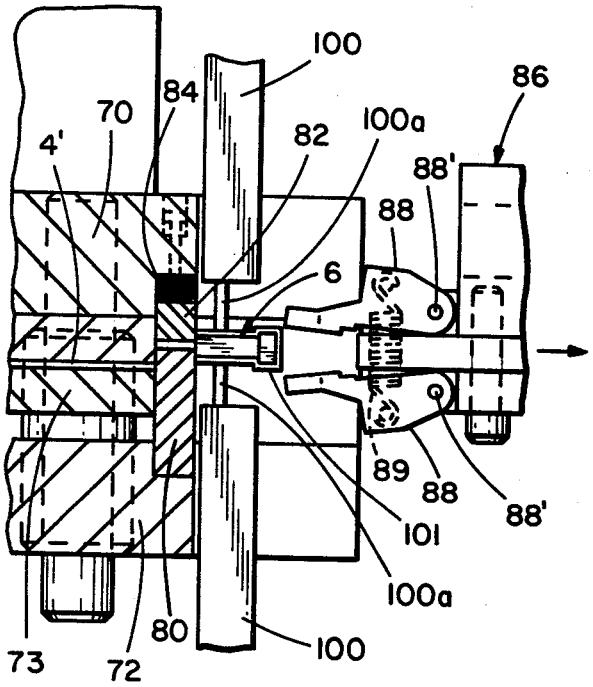
FIG. 19 is a view corresponding to FIG. 17 when the housing applying unit is in the process of being withdrawn from the staked housing shown in FIG. 17.
Figure 20:
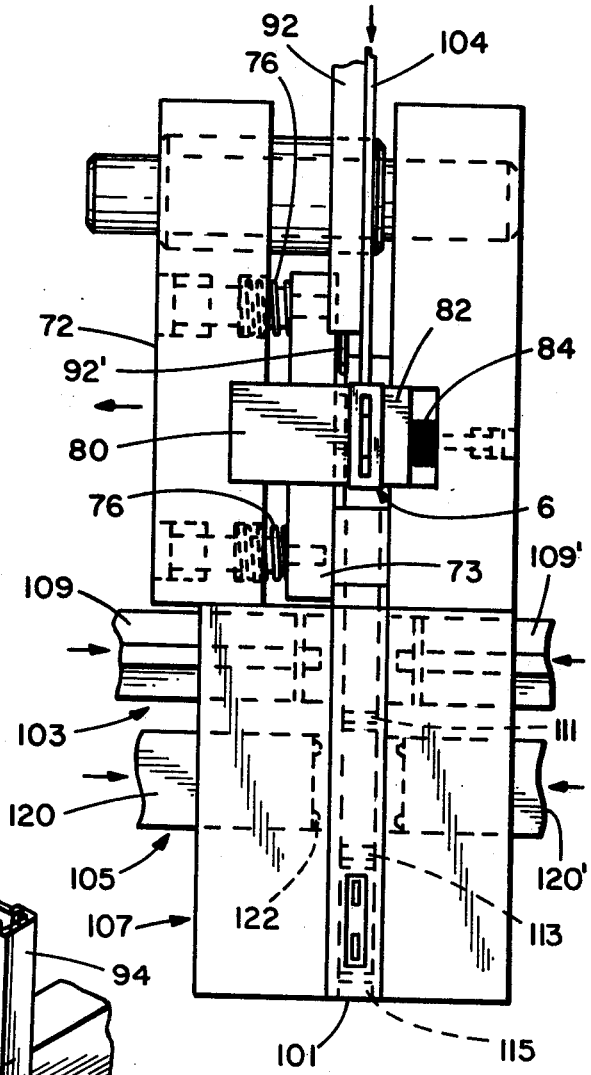
FIG. 20 is a sectional view through the machine of FIG. 13, as seen along viewing plane 20—20 therein.

The endmost blank 4'' of the strip 4' is shown in FIG. 13 projecting beyond a vertical bearing surface 77 formed in the die unit 70, the bearing surface 77 extending at right angles to the strip 4'. As shown in both FIGS. 12 and 13, the blanking operations carried out by the punches 72a, 72b, 72c, 72d, etc. form the terminal blade portions 8—8 and current-carrying extensions 14—14 so that they are longitudinally oriented and spaced and relative to one another, with the current-carrying extensions being positioned closer to the end of the strip than the terminal blade portions in each blank portion of the strip. The endmost projecting end blank 4'' passes between a punch 80 mounted on the punch and a backing member 82, both the punch 80 and the backing member 82 being positioned opposite the terminal blade portions of this end blank and being of a width no greater than about the length of the terminal blade portions so that the rest of the blank is fully exposed to receive a housing 6 thereover. Mounted behind the backing member 82 is a coil spring 84 or the like which spring biases the backing member forwardly and which spring is completely compressed when the punch is moved rearwardly to sever the end blank from the strip. The bearing surface 77 terminates in an upwardly longitudinally extending wall surface 77' and forms at the junction therewith a severing edge 77'' against which the punch 80 pushes the projecting end of the end blank 4'' to sever the same thereat. As the punch 80 moves forwardly to completely retract the backing member 84, the severed end blank 4'' is tightly clamped between the punch 80 and the backing member 82, with the end edges of the terminal blade portions 8—8 of the severed blank being contiguous to the bearing surface 77.

As the punch 80 is moved rearwardly against the backing member 82, the other punches 72a, 72b, 72c, 72d, etc. carried by the punch carrier 72 will form the various apertures in the strip 4' described in connection with FIG. 12.

There is provided opposite and in alignment with the point where the severed end blank 4'' is clamped in position a housing applying unit 86 comprising a frame structure 86a mounted for horizontal reciprocating movement by a solenoid operated arm 87. The left-hand of the unit 86 as viewed in FIGS. 13 and 14 carries a pair of horizontally spaced confronting jaws 88—88 which are pivotally mounted at 88'—88' and lightly spring-urged by a coil spring 89 toward one another. An upwardly and forwardly opening housing-receiving recess 90 having the same shape as the housing 6 is defined between the closed jaws for receiving a housing 6 dropping from an opening in the bottom of a vertical chute 94 having a vertical housing-receiving passageway 94' therein having the same shape as the housing cross section. The housings which are stacked in the chute 94 are horizontally oriented so that the fuse element-receiving openings thereof face in a direction of the clamped severed end blank 4''. A continuous relatively light feed pressure may be applied to the stack of housings supported within the chute passageway 94' so that when the housing-receiving recess 90 defined between the jaws 88—88 passes beneath the chute discharge opening, a housing will be fed within the jaw-defined housing-receiving recess 90. The frame structure 86a has a horizontal top surface 86a'' which keeps the bottommost housing in the chute 94 within the chute until the jaw-defined housing-receiving recess 90 is aligned with the chute discharge opening. The housing 6 fed between the jaws 88—88 comes to rest as it seats upon a shoulder 91 formed by a portion of the frame structure 86a of the housing applying unit 86.

A cam operated vertical arm 92 positioned above the point where the clamped, severed end blank 4'' is located carries a downwardly extending curve contact 92' which, as the contact engages the upper edge of a severed and clamped end blank 4'', effects the energization of a solenoid (not shown) which causes the housing applying unit 86 to move to the left, to bring the open end of the housing 6 held by the jaws 88—88 over the exposed portion of the plug-in fuse element formed by the severed clamped end blank. The force applied to this severed end blank as the housing is pushed thereover is taken up by the bearing surface 77 against which the ends of the terminal blades 8—8 thereof abut. (If desired, when the curved contact 92' fails to sense the presence of an end blank 4'' at the testing period a motor which drives all of the control cams may be de-energized, indicating something is wrong in the operation of the machine involved.) The vertical arm 92 is raised and lowered periodically so that it is in position to sense the presence of a clamped end blank 4'' at the appropriate time.

As soon as the housing is fully inserted over the severed end blank, front and rear cam operated staking tools 100—100 move toward one another to bring vertically spaced pairs of staking projections 100a—100a against the opposite walls of the housing 6 to stake the synthetic plastic material of the housing 6 into the apertures 26—26 in the plug-in fuse element involved. Clearance spaces for the passage of the staking projections 100a—100a are provided by laterally and forwardly opening apertures 99—99 in the jaws 88—88, as shown in FIGS. 13 and 21, which permit the jaws to retract while the staking projections remain in place.

Upon completion of this staking operation, and before the front and rear staking tools 100 and 100' are separated, the housing applying unit 86 is returned to its initial right hand position following which the staking projections 100a—100a are withdrawn from the housing 6 as a stripper bar 104 is momentarily moved downwardly to engage the housing 6 inserted over the severed end blank 4'' either to depress the resulting plug-in fuse assembly into a collection container from which the assemblies involved are delivered to other apparatus for performing other operations to be described, or, as illustrated, into a receiving chute 101 where the original orientation of the plug-in fuse assembly involved is maintained so that these other operations may be performed on the plug-in fuse assembly. Thus, as illustrated, the chute 101 passes through a coining and web severance station 103, an ultrasonic welding station 105, and a fuse test station 107. At the coining and web severance station 103, a pair of coining and web severance dies 109—109 (FIG. 21) are brought together to punch the web 10′ from the plug-in fuse assembly involved formed between the terminal blades 8—8 thereof and to form the tapered terminal blade ends 9—9 shown in FIG. 1. The plug-in fuse assemblies at the stations 103, 105 and 107 are maintained at a desired elevation within the chute 101 by suitable reciprocating holder bars 111, 113 and 115 respectively. The plug-in fuse assemblies are moved down the chute 101 by force of gravity when they are free to do so.

Figure 21:
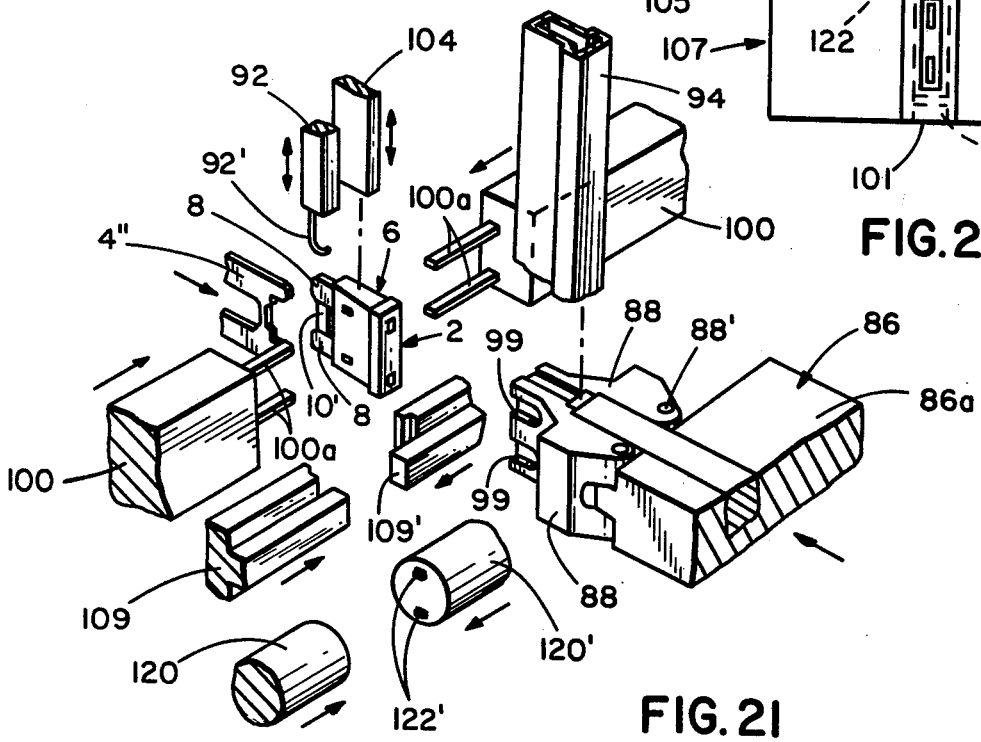
FIG. 21 is a perspective view of many of the operating components of the machine shown in FIGS. 13 through 20.

At the ultrasonic welding station 105 a pair of ultrasonic welding members 120–120′ FIG. 21 each having a pair of welding projections, are brought into position within the depressions 56—56 (FIG. 1) formed by the staking operation, momentarily to melt the synthetic plastic material forming the housing thereat to weld the staking projections 52—52 (FIG. 6) together.

At the fuse test station 107 a suitable electrical resistance testing devices 125 having electrical probes (not shown) are pushed through the housing apertures 42—42 so that the probes make contact with the tabs 18—18 of the plug-in fuse element 4 involved. The probes are mounted for horizontal reciprocating movement under control of a cam 127 shown in FIG. 13. If a particular plug-in fuse assembly being tested does not fall within a desired named range of resistance values the plug-in fuse assembly involved may be ejected by suitable laterally operating ejecting means (not shown) to discharge it along a different path from those plug-in fuse assemblies which pass the test.

The present method and apparatus invention just described and shown in the drawings can be modified in many respects without deviating from the broader aspects of the present invention. However, the apparatus illustrated is the preferred form constituting a specific aspect of the invention as claimed.

I claim:

1. A method of mass producing plug-in fuse assemblies each including a plug-in fuse element comprising a plate-like body of fuse metal having a pair of spaced confronting generally parallel terminal blade portions to be received by pressure clip terminals or the like, current-carrying extensions at the inner ends of said pair of terminal blade portions and a fuse link portion interconnecting the current-carrying extensions, and an insulating unit rigidly extending between said current-carrying extensions, said method comprising the steps of providing a strip of fuse metal having longitudinally spaced blank portions from which individual plug-in fuse elements are to be formed, sequentially advancing the strip of fuse metal past punch and die assemblies which form in each blank portion of the strip said pair of terminal blade portions and current-carrying extensions interconnected by said fuse link portion; providing a punch assembly including a punch unit and backing means therefor, said punch and backing means having a width no greater than the length of said terminal blade portions; positioning the terminal blade portions of the end blank portion of the strip between said punch and backing means; moving the punch against the terminal blade portions of the end blank portion of the strip to sever the same from the strip and to bring the severed blank against the backing means where it is clamped securely between the punch and the backing means; and providing an insulating unit with an entry opening at one end adapted to receive the current-carrying extensions and fuse link portion of the severed end blank and pushing said insulating unit over the current-carrying extensions of the end blank clamped between said punch and said backing means.

2. The method of claim 1 wherein said insulating means forms a housing enclosure for said current-carrying extension and fuse link portion of the severed end blank.

* * * * *